US006672189B1

(12) United States Patent
Aiken et al.

(10) Patent No.: US 6,672,189 B1
(45) Date of Patent: Jan. 6, 2004

(54) CONSTRUCTION TOY DEVICE AND METHOD OF USING THE SAME

(75) Inventors: Brian L. Aiken, East Aurora, NY (US); Jon Paul Castiglione, West Seneca, NY (US); Kevin C. Dakan, Amherst, NY (US); David E. Grober, East Aurora, NY (US); Jeffrey J. Miller, Orchard Park, NY (US); Charles W. Paddock, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 161 days.

(21) Appl. No.: 09/876,162

(22) Filed: Jun. 8, 2001

(51) Int. Cl.[7] ..... B26D 1/02; B26D 3/10
(52) U.S. Cl. ..... 83/284; 83/410.8; 83/733
(58) Field of Search ..... 83/733, 284, 410.5, 83/410.9; 82/93

(56) References Cited

U.S. PATENT DOCUMENTS 387,692 A * 8/1888 Newman ..... 223/16
596,738 A * 1/1898 Castle ..... 83/410.9
1,850,097 A * 3/1932 Finn ..... 83/410.9
2,653,633 A * 9/1953 Anderson ..... 144/154
3,237,499 A * 3/1966 Lohrand ..... 83/510
3,299,877 A * 1/1967 Grage ..... 125/21
3,301,110 A * 1/1967 Stegner ..... 83/56
4,436,010 A * 3/1984 Valentine ..... 83/171
4,860,622 A * 8/1989 Di Bernardo ..... 83/285
5,123,318 A * 6/1992 Su et al. ..... 83/289
5,558,564 A * 9/1996 Ascalon ..... 451/66

OTHER PUBLICATIONS

Toobz Product Advertisement (1 page) (undated).

Li'l Playmate Paper Artist (1 page) (undated).

* cited by examiner

*Primary Examiner*—Kenneth E. Peterson
(74) *Attorney, Agent, or Firm*—Cooley Godward LLP

(57) ABSTRACT

A construction toy device that can be used to create multiple construction elements and methods of using the same are disclosed.

20 Claims, 18 Drawing Sheets

CONSTRUCTION TOY DEVICE AND METHOD OF USING THE SAME

BACKGROUND OF THE INVENTION

This invention relates generally to a construction toy device, and in particular, to a device that can be used to create construction elements from a piece of material.

Construction toys provide entertainment for children. Children can develop their imagination by playing with construction toys. Construction toys that are reconfigurable to form a variety of characters, objects, etc. enhance the possibilities for creative playing by children. The need exists for a construction toy device that can be used to create construction toy elements.

SUMMARY OF THE INVENTION

Generally, the embodiments of the invention disclose a construction toy device that can be used to create and/or modify construction toy elements from one or more pieces of material. In one embodiment, the construction toy device includes a cutter mechanism that can be used to cut a piece of material into a work piece. In another embodiment, the construction toy device includes a die mechanism that can be used to form or modify construction elements from a work piece. In another embodiment, the construction toy device includes a cutter mechanism and/or a die mechanism. In another embodiment, the construction toy device includes a punching mechanism that can be used to create or modify construction toy elements.

DETAILED DESCRIPTION OF THE INVENTION

A construction toy device can be used to create and/or modify construction toy elements from one or more pieces of material. In one embodiment, the construction toy device includes a cutter mechanism that can be used to cut a piece of material into a work piece. In another embodiment, the construction toy device includes a die mechanism that can be used to form construction elements from a work piece. In another embodiment, the construction toy device includes a cutter mechanism and/or a die mechanism. In another embodiment, the construction toy device includes a punching mechanism that can be used to create or modify construction toy elements.

In an embodiment, the construction toy device includes a housing, a cutter mechanism, a die mechanism, and/or an actuator. In one embodiment, the cutter mechanism is coupled to the housing. The cutter mechanism supports and prepares a piece of material into a work piece.

In one embodiment, the construction toy device includes a die mechanism that is coupled to the housing. The die mechanism may be any mechanism that can provide pressure on a die or die shell to form construction elements in a work piece. A work piece is placed in a die shell that is inserted into the die mechanism.

In the illustrated embodiment, the actuator is coupled to the housing. In one embodiment, the actuator is operably coupled to the cutter mechanism. As the actuator is activated, the cutter mechanism prepares or cuts the piece of material to form a work piece. The actuator is operably coupled to the die mechanism.

The die mechanism includes a roller that is coupled to the actuator. As the actuator is activated, the roller rotates and advances a die shell through the die mechanism. In one embodiment, the actuator simultaneously moves part of the cutter mechanism and moves the roller of the die mechanism.

Figure 1:
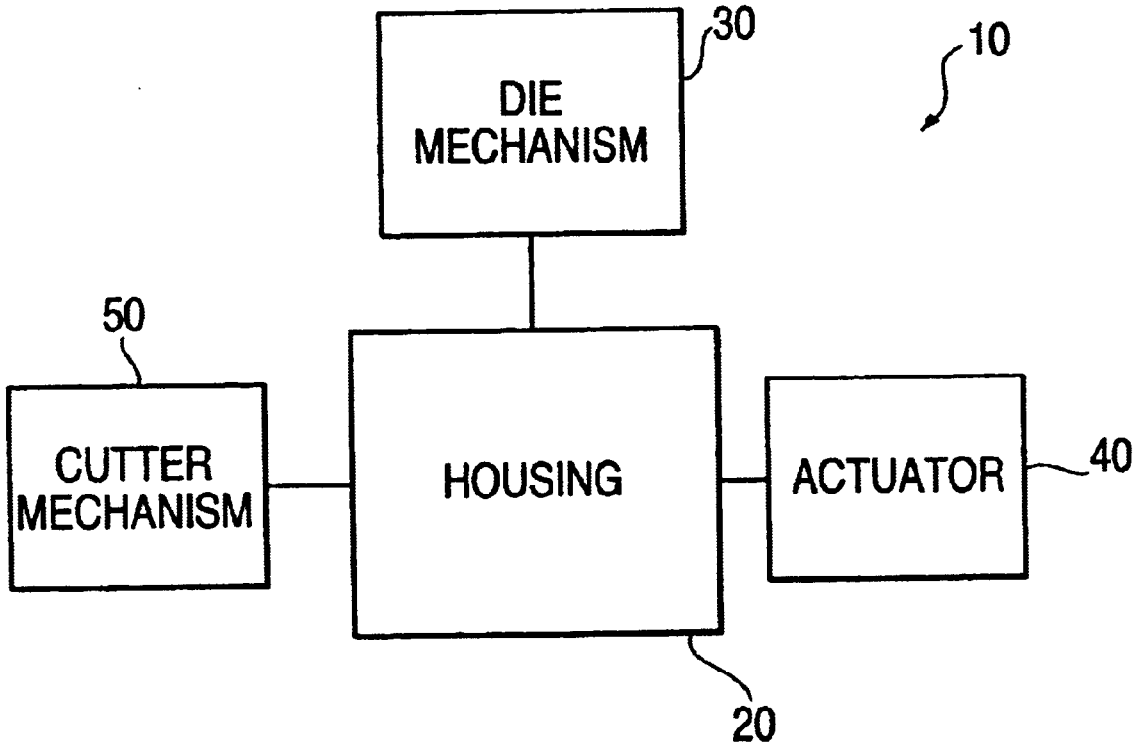
FIG. 1 illustrates a schematic view of the operational components of a construction toy device according to an embodiment of the invention.

A construction toy device according to an embodiment of the invention is illustrated in FIG. 1. FIG. 1 illustrates a schematic view of some of the components of the construction toy device 10. In the illustrated embodiment, the toy device 10 includes a housing 20.

In the illustrated embodiment, the construction toy device 10 includes a die mechanism 30 and a cutter mechanism 50 coupled to the housing 20. However, it is not necessary to include a die mechanism and a cutter mechanism in the construction toy device.

Cutter mechanism 50 may be any mechanism that can be used to prepare, cut, trim, etc. a piece of material into a different piece of material or work piece with a desired shape (not shown) for processing by a die mechanism 30. For example, the cutter mechanism can include a supporting portion for supporting or guiding a piece of material and a cutting portion. In one embodiment, the supporting portion can move relative to the cutting portion. For example, the supporting portion may rotate relative to the cutting portion to enable the cutting portion to engage the piece of material. In an alternative embodiment, the cutting portion can move relative to the supporting portion. For example, the cutting portion can be mounted so that it travels around the supporting portion to cut the material.

The die mechanism 30 may be any mechanism that can provide pressure on a die or die shell to form construction elements in a work piece in the die or die shell. For example, the die mechanism can include a pressure location that is fixed through which a die shell passes. Alternatively, the die mechanism can include a pressure location that moves relative to a die shell. In one embodiment, the die mechanism can include pair of rollers that rotate and advance a die shell. In another embodiment, the die mechanism can include a roller that is movable along a plate or support surface on which a die shell is disposed. In another embodiment, the die mechanism can include one or more belts or other rotating mechanism that can advance a die shell through a pressure location. Die mechanism 30 can be used to form patterns in the work piece to create multiple construction elements that can be used to form different structures, figures, etc.

In the illustrated embodiment, the toy device 10 includes an actuator 40 that is coupled to the housing 20. The actuator 40 is operably coupled to the cutter mechanism 50. A user can activate the actuator 40 to cause the cutter mechanism 50 to prepare a piece of material.

In one embodiment, the actuator 40 is operably coupled to a die mechanism 30. A user can activate the actuator 40 to advance a die shell containing a work piece through the die mechanism 30 or to move part of the die mechanism relative to a die shell. In one embodiment, activation of the actuator 40 causes the die mechanism 30 and the cutter mechanism 50 to operate simultaneously.

Figure 2:
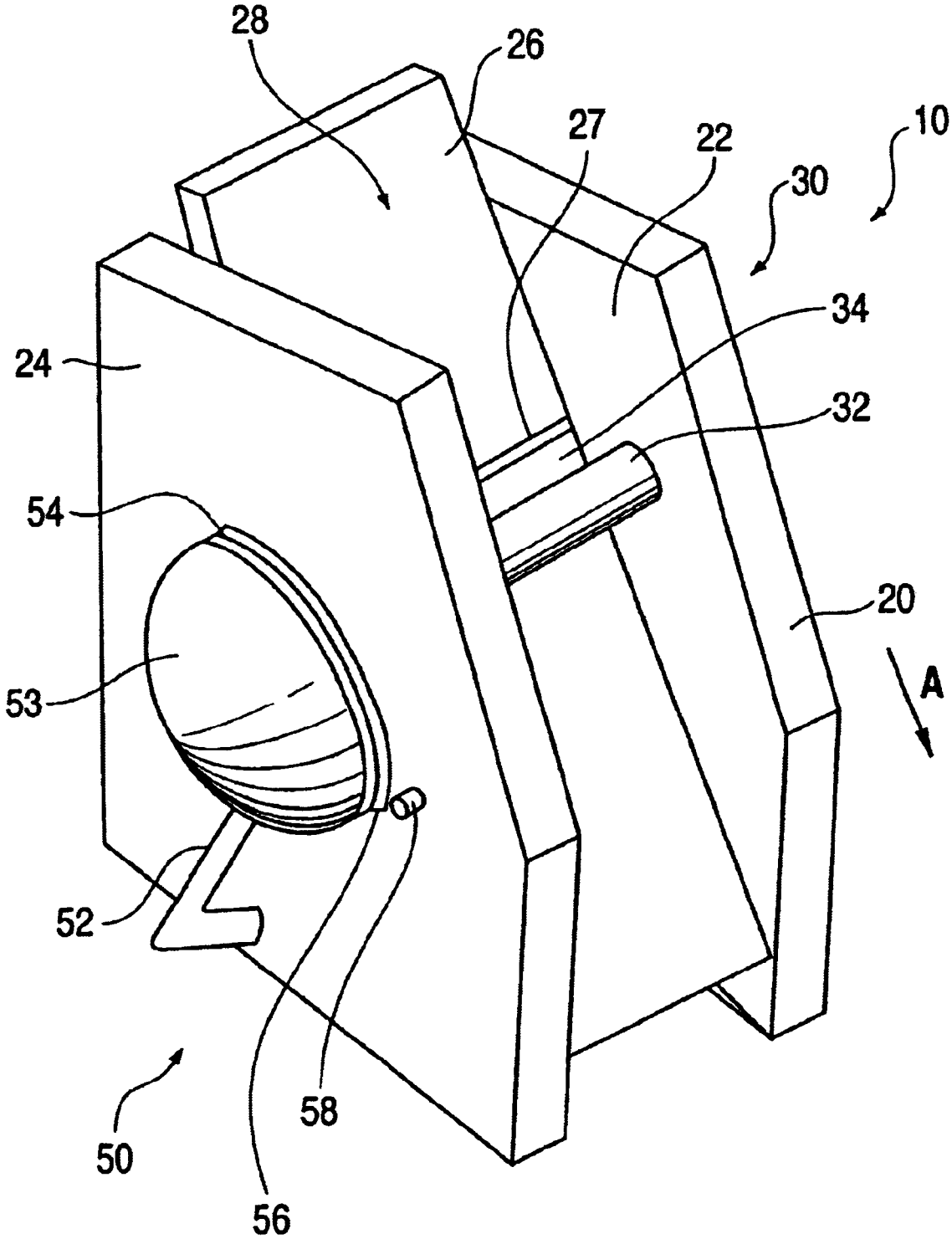
FIG. 2 illustrates a perspective view of an embodiment of a construction toy device embodying the principles of the invention.

An implementation of the construction toy device is illustrated in FIGS. 2–5. In the illustrated embodiment, the toy device 10 includes a housing 20 includes side walls 22 and 24 and a guide plate 26. In one embodiment, the guide plate 26 includes an opening 27 as illustrated in FIG. 2. The side walls 22 and 24 and the guide plate 26 define a passageway or channel 28 therebetween. In one embodiment, the passageway 28 extends substantially along the length of the guide plate 26.

In the illustrated embodiment, the toy device 10 includes a die mechanism 30 coupled to the housing 20. As illustrated in FIG. 2, the die mechanism 30 includes a pair of rollers 32 and 34. Rollers 32, 34 are coupled at each of their ends to side walls 22 and 24. In one embodiment, roller 34 is mounted in opening 27 in guide plate 26.

Rollers 32 and 34 are mounted substantially parallel and spaced apart. The distance between the rollers 32 and 34 enables a die shell 80 (see FIG. 7) to pass between the rollers 32 and 34. As the die shell 80, passes between the rollers 32 and 34 along the direction of arrow "A" in FIG. 2, a force is applied to the die shell to process the work piece in the die shell, as discussed in detail below.

Figure 3:
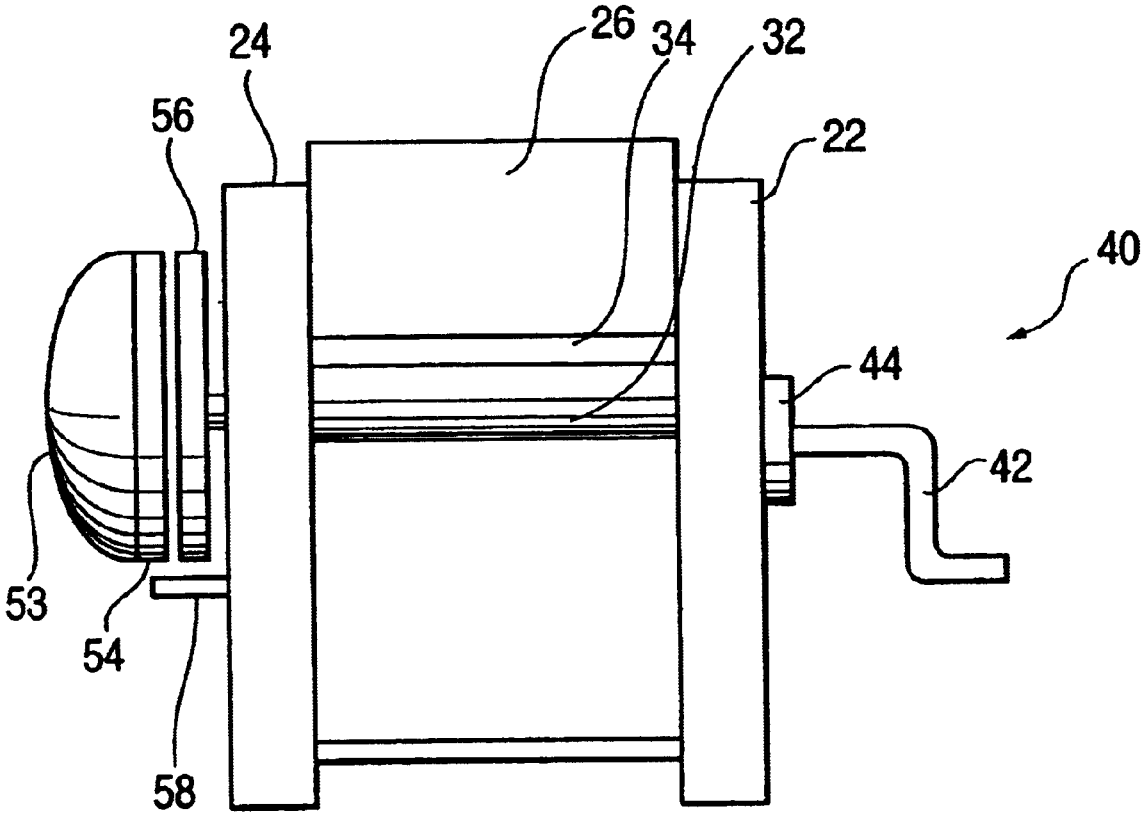
FIG. 3 illustrates a front view of the construction toy device of FIG. 2.
Figure 4:
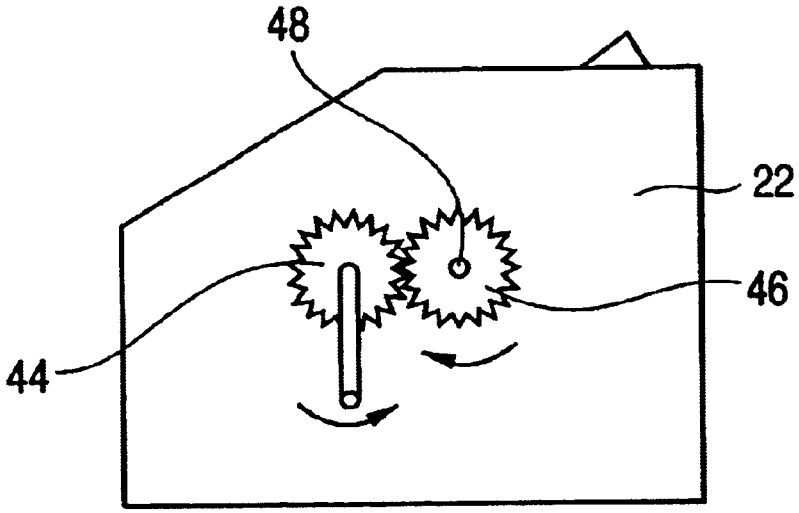
FIGS. 4 and 5 illustrate side views of the construction toy device of FIG. 2.
Figure 5:
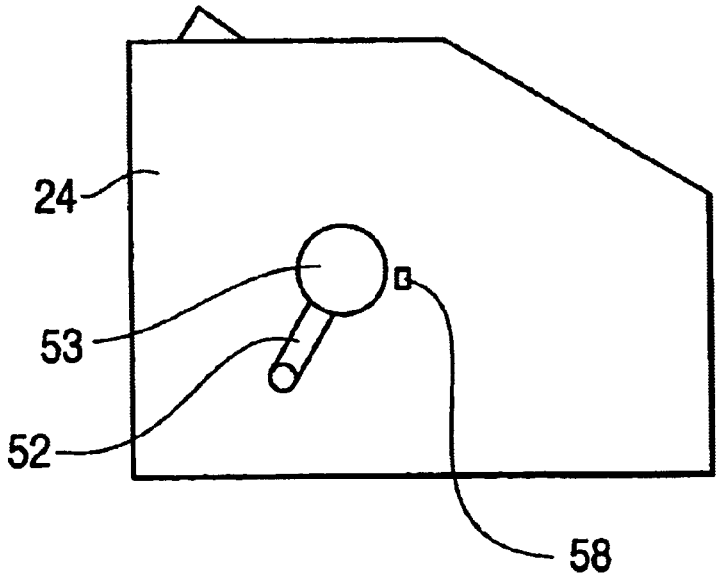

In the illustrated embodiment, the toy device 10 includes an actuator mechanism 40 coupled to the housing 20. An embodiment of an actuator mechanism is illustrated in FIGS. 3 and 4. Actuator mechanism 40 includes a handle 42 and gears 44 and 46. Gear 46 is mounted on axle 48 which is rotatably supported by side walls 22 and 24. Handle 42 is operatively coupled to gear 44 engages gear 46. As a user rotates handle 42, gears 44 and 46 rotate, thereby causing axle 48 to rotate.

In the illustrated embodiment, roller 32 is mounted on and operatively coupled to axle 48. Thus, a user can rotate roller 32 by rotating handle 42. Roller 34 is an idler or geared roller that rotates as a die shell advances between rollers 32 and 34. In an alternative embodiment, rollers 32 and 34 can be driven directly by actuator mechanism 40.

As illustrated in FIG. 2, the construction toy device 10 includes a cutter mechanism 50. In one embodiment, the cutter mechanism 50 includes a support arm 52 that is pivotally coupled to the housing 20. The support arm 52 includes a clamping portion 53 adjacent one of the ends of arm 52.

In the illustrated embodiment, the cutter mechanism 50 includes a first mounting plate 54 rotatably coupled to the clamping portion 53 and a second mounting plate 56 supported on the housing 20. In one embodiment, mounting plate 56 is operatively coupled to axle 48. As a user rotates handle 42, mounting plate 56 rotates relative to the housing 20.

In the illustrated embodiment, the support arm 52 is disposable in a first or clamping position in which mounting plate 54 is disposed proximate to mounting plate 56, as illustrated in FIG. 2. The support arm 52 is disposable in a second or opened position in which mounting plate 54 is spaced apart from mounting plate 56. In one embodiment, the support arm 52 is biased into its clamping position by a biasing mechanism, such as a spring (not shown).

The cutter mechanism 50 also includes a cutting device 58 that extends from housing 20. Cutting device 58 may be any mechanism that can cut a piece of material. In one embodiment, cutting device 58 is a blade that is coupled to the housing 20. In an alternative embodiment, cutting device 58 is coupled to the support arm 52. In an alternative embodiment, the cutting device may be adjustably mounted to enable a user to vary the diameter of the piece of material that is cut by the cutter mechanism.

A user can move the support arm 52 into its open position and place a piece of material between mounting plates 54 and 56. When the support arm 52 returns to its clamping position, the piece of material is supported between mounting plates 54 and 56. The cutting device 58 is arranged so that it engages a piece of material between the mounting plates 54 and 56. As the user rotates handle 42, mounting plate 56 rotates, thereby causing the piece of material and mounting plate 54 to rotate. Cutting device 58 cuts the piece of material as the material rotates.

Figure 6:
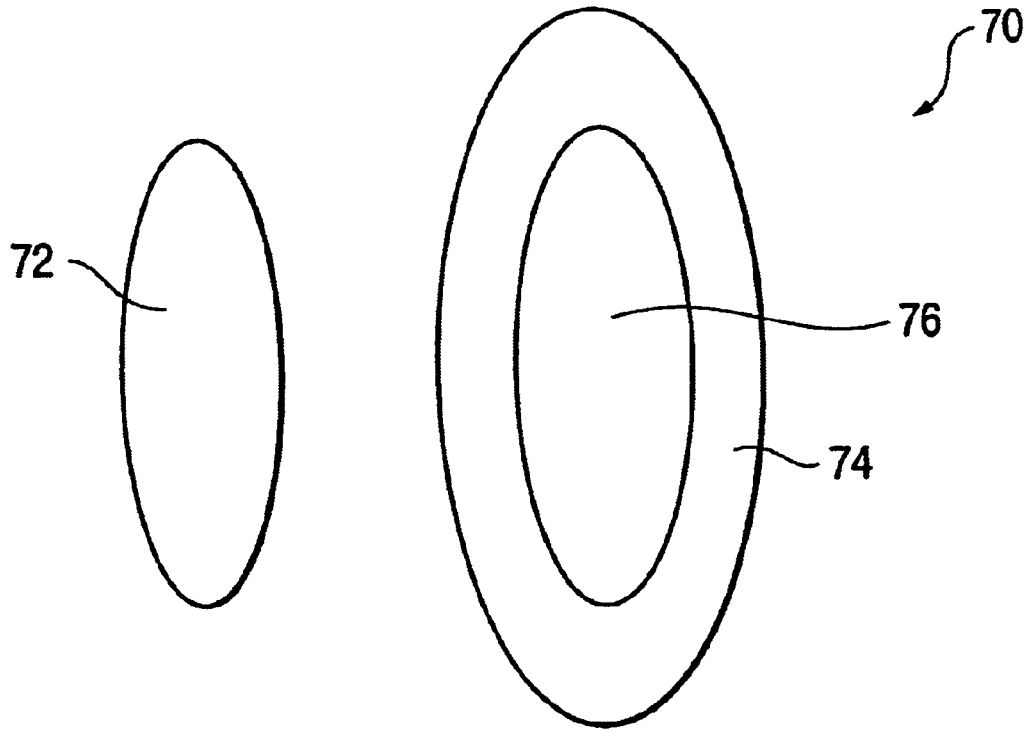
FIG. 6 illustrates a processed piece of material embodying the principles of the invention.

An embodiment of a piece of material is illustrated in FIG. 6. In the illustrated embodiment, the construction toy device 10 cuts a piece of material 70 into a first piece of material or work piece 72 and a second piece of material 74. As illustrated in FIG. 6, the first piece of material 72 is a circular blank and the second piece of material 74 is an outer rim with a central opening 76. Once a work piece 72 is prepared or cut from the piece of material 70, the work piece 72 can be placed into a die shell. The diameter of the circular blank is determined by the location of the cutting device 58.

Figure 7:
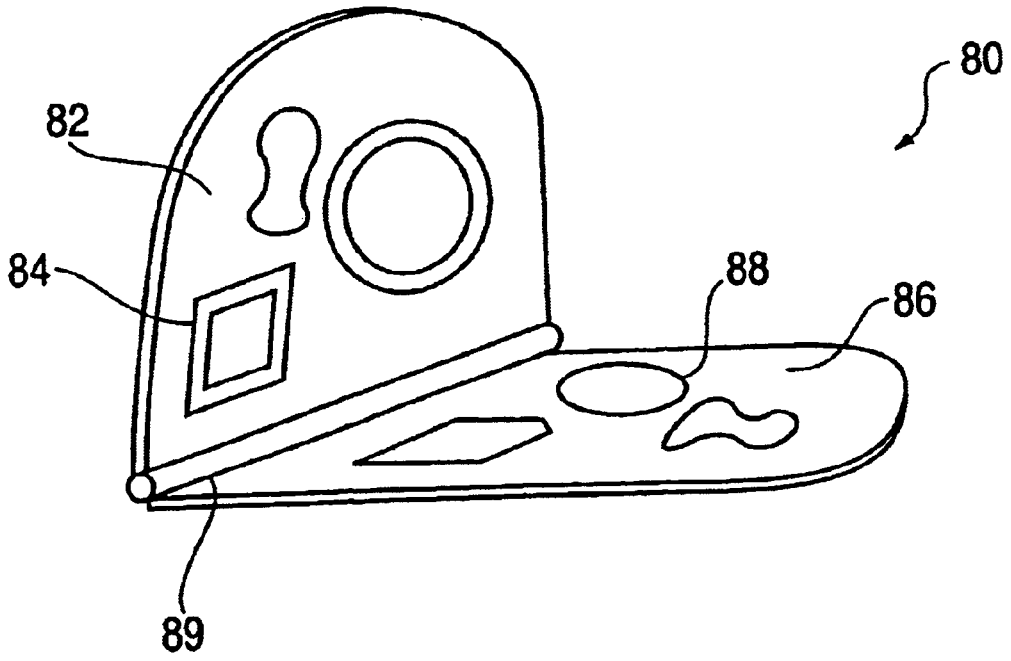
FIG. 7 illustrates a perspective view of an embodiment of a die shell embodying the principles of the invention.

An embodiment of a die shell is illustrated in FIG. 7. In the illustrated embodiment, die shell 80 includes a first die portion 82 and a second die portion 86 that are coupled together. In one embodiment, first and second die portions 82 and 86 are coupled together by a hinge 89. In an alternative embodiment, first and second die portions 82 and 86 can be coupled together using any conventional mechanism that allows relative movement between the die portions.

As illustrated in FIG. 7, first and second die portions 82 and 86 include embossments 84 and 88. In one embodiment, first die portion 82 includes female embossments 84 and second die portion 84 includes male embossments 88. As the die portions 82 and 86 are closed with a work piece 72 disposed therebetween, the male embossments 88 engage the blank 72 and cut lines therein. In an alternative embodiment, only one of the die portions includes male embossments 88. The embossments may be any desired shape or configuration.

In the illustrated embodiment, the components of the construction toy device are made from plastic. However, any suitable material may be used. In the illustrated embodiment, the piece of material is expanded polystyrene foam. However, any material that can be cut or modified and has sufficient structural rigidity to be interconnected or assembled to form an object, structure, or other device may be used. For example, the piece of material may be paper, cardboard, plastic, plastic foam, etc.

Figure 8:
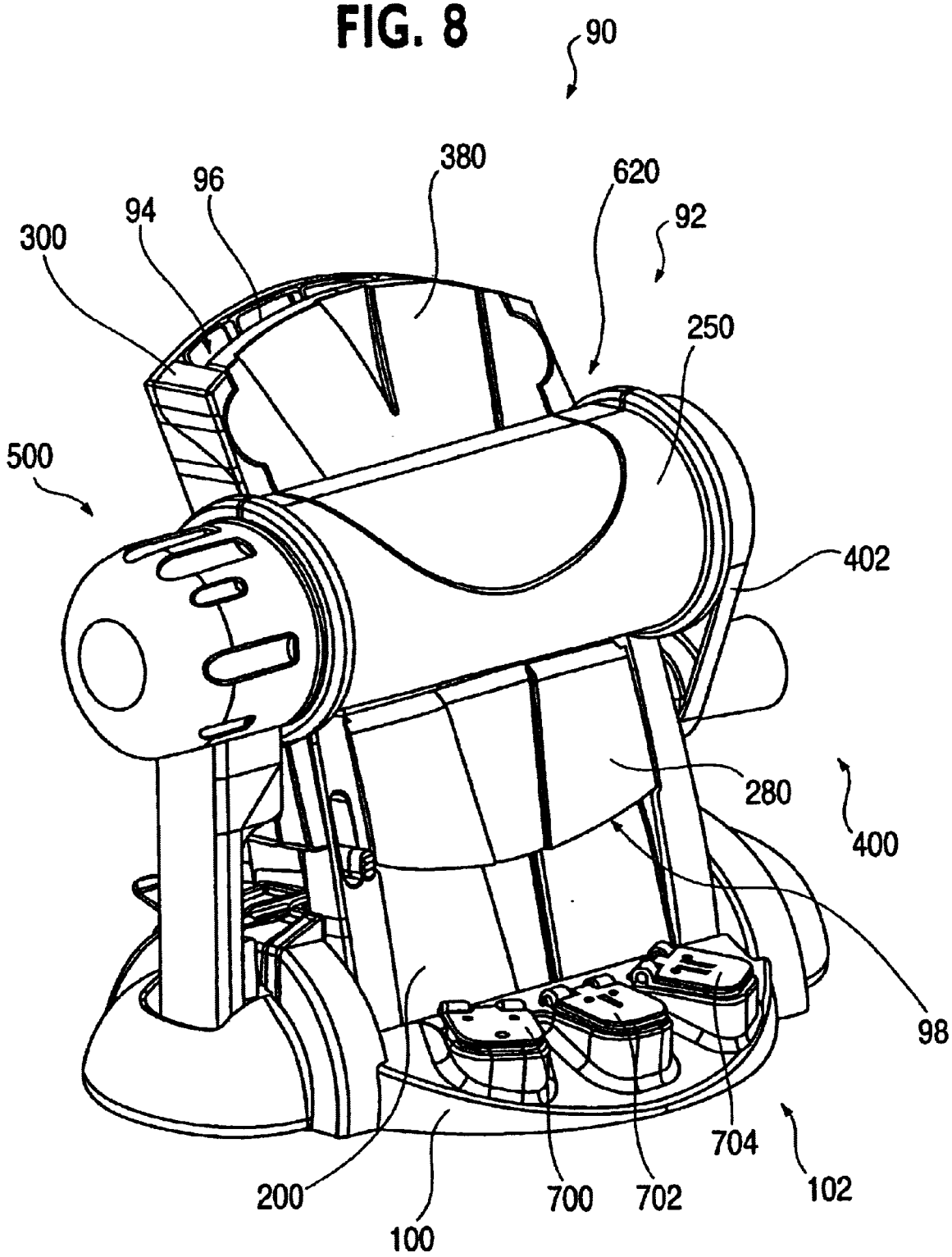
FIG. 8 illustrates a perspective view of an alternative embodiment of a construction toy device embodying the principles of the invention.

An alternative embodiment of a construction toy device embodying the principles of the invention is illustrated in FIG. 8. Construction toy device 90 includes a base 100, a front cover member 200, and a rear cover member 300. In the illustrated embodiment, the base 100, front cover 200, and rear member 300 are coupled together and form a housing 92.

In the illustrated embodiment, the toy device 90 includes a cutter mechanism 500 coupled to the housing 92. Cutter mechanism 500 can be used to prepare or cut a piece of material into a work piece.

In the illustrated embodiment, the toy device 90 includes a die mechanism 620 coupled to the housing 92. Die mechanism 620 includes a roller (discussed below) that applies force to a die shell to process the work piece, as discussed in detail below.

In one embodiment, construction toy device 90 includes an upper plate 380 and a lower plate 280 that are coupled to the housing 92. In one embodiment, lower plate 280 is coupled to the front cover 200 and upper plate 380 is coupled to the rear cover 300. Upper and lower plates 280 and 380 restrict access to the roller support portion 250 of the toy device 90 to reduce the risk that a user inserts his or her fingers into the die mechanism in the roller support portion 250.

As illustrated in FIG. 8, a portion of the upper plate 380 is spaced apart from the rear cover 300. The upper plate 380 and the rear cover 300 define a passageway 94 into which a die shell can be inserted. The lower plate 280 is spaced apart from the front cover 200 to define a portion of passageway 94. The passageway 94 includes an inlet portion 96 and an outlet portion 98.

In the illustrated embodiment, the toy device 90 includes an actuator 400 coupled to the housing 92. In one embodiment, actuator 400 is operatively coupled to the cutter mechanism 500 and the die mechanism 620. The operation of the actuator 400 is discussed in detail below.

Figure 9:
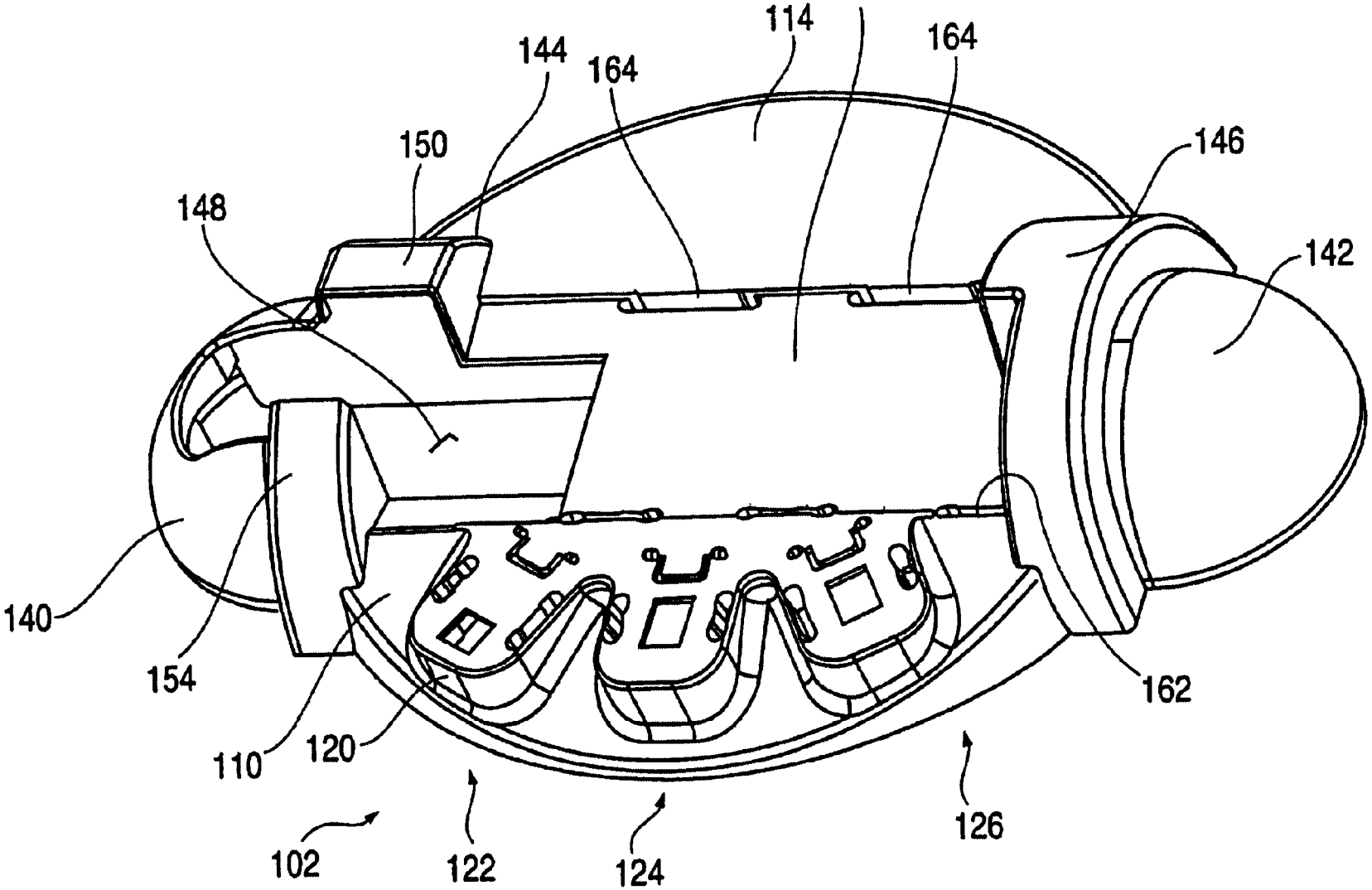
FIG. 9 illustrates a perspective view of a base of the construction toy device of FIG. 8.

An embodiment of a base is illustrated in FIG. 9. Base 100 includes upper surface portions 110, 112, and 114 and end portions 140 and 142. Base 100 also includes walls 144 and 146 disposed between the upper surface portions and end portions.

As illustrated in FIG. 9, wall 144 includes a first portion 150 and a second portion 154 that define an opening 148 therebetween. Portions of the front and rear covers 200 and 300 are inserted into the opening 148 when the housing 92 is assembled. In one embodiment, surface 112 includes several slots or openings 162 and 164. The front and rear covers 200 and 300 are coupled to the base 100 via slots 162 and 164 as discussed in detail below.

In one embodiment, base 100 includes a stamping portion 102. As illustrated in FIG. 9, stamping portion 102 includes a wall 120 that defines several stamping portions 122, 124, and 126. Each stamping portion 122, 124, and 126 is adapted to receive a corresponding punch 700, 702, and 704, as illustrated in FIG. 8.

Figure 10:
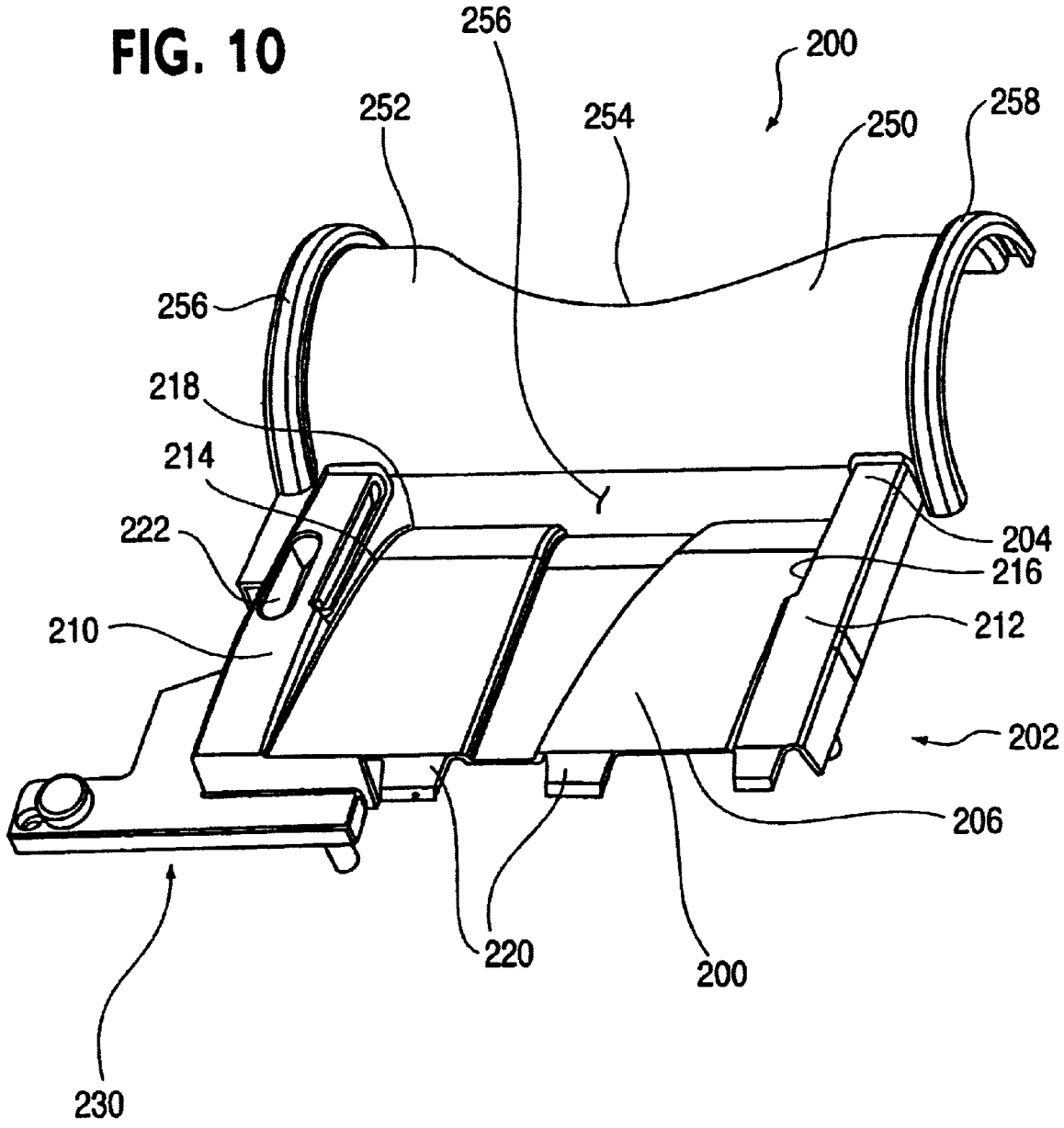
FIGS. 10 and 11 illustrate front and rear perspective views of a front cover of the construction toy device of FIG. 8.
Figure 11:
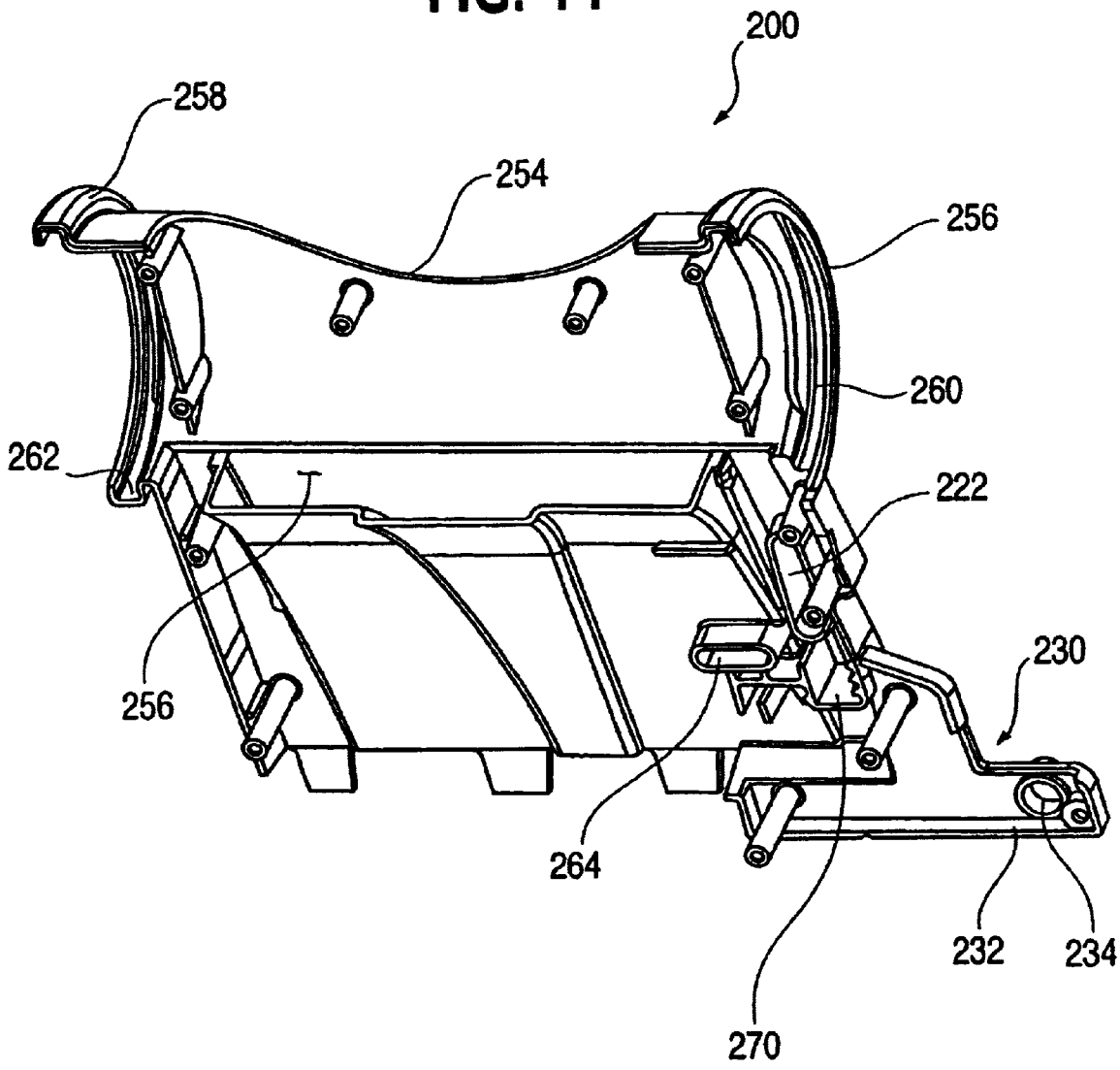

An embodiment of a front cover is illustrated in FIGS. 10 and 11. Front cover 200 includes a guide portion 202 and a roller support portion 250. Guide portion 202 is coupled to the roller support portion 250. Front cover 200 includes an opening 256 between the guide portion 202 and the roller support portion 250. The opening 256 is sized to enable a die shell to pass therethrough.

Guide portion 202 includes an upper end 204 and a lower end 206. As illustrated in FIG. 10, upper end 204 is coupled to the roller support portion 250. The front cover 200 includes tabs 220 along the lower end 206. As the front cover 200 is coupled to the base 100, tabs 220 engage slots 162 on the base 100 to secure the front cover 200 and base 100 together.

Guide portion 202 includes a guide surface 208 and side walls 210 and 212. In one embodiment, each of the side walls 210 and 212 extends along the length of the guide surface 208. Side walls 210 and 212 include notches 214 and 216, respectively, formed in a portion of their inner surfaces. Each notch 214 and 216 includes an opening 218 located proximate to its upper end.

In the illustrated embodiment, the roller support portion 250 includes an outer surface 252. The outer surface 252 includes a curved edge 254. In one embodiment, the roller support portion 250 includes collars or shoulders 256 and 258 disposed at each end. As illustrated in FIG. 11, collars 256 and 258 include grooves 260 and 262, respectively, formed along their inner surfaces.

As illustrated in FIG. 11, front cover 200 includes a mounting portion 230 having an extension 232 and a recess 234. Mounting portion 230 is inserted into opening 148 of the base 100. Front cover 200 also includes a slot 222 formed in side wall 210. In the illustrated embodiment, front cover 200 includes slot 264 and cavity 270 formed on the inner surface of the front cover 200. The functions of the slots and cavity are discussed in greater detail below.

As illustrated in FIG. 11, the roller support portion 250 is substantially cylindrical. In alternative embodiments, the roller support portion may be any size, shape, or configuration that can support the die mechanism.

Figure 12:
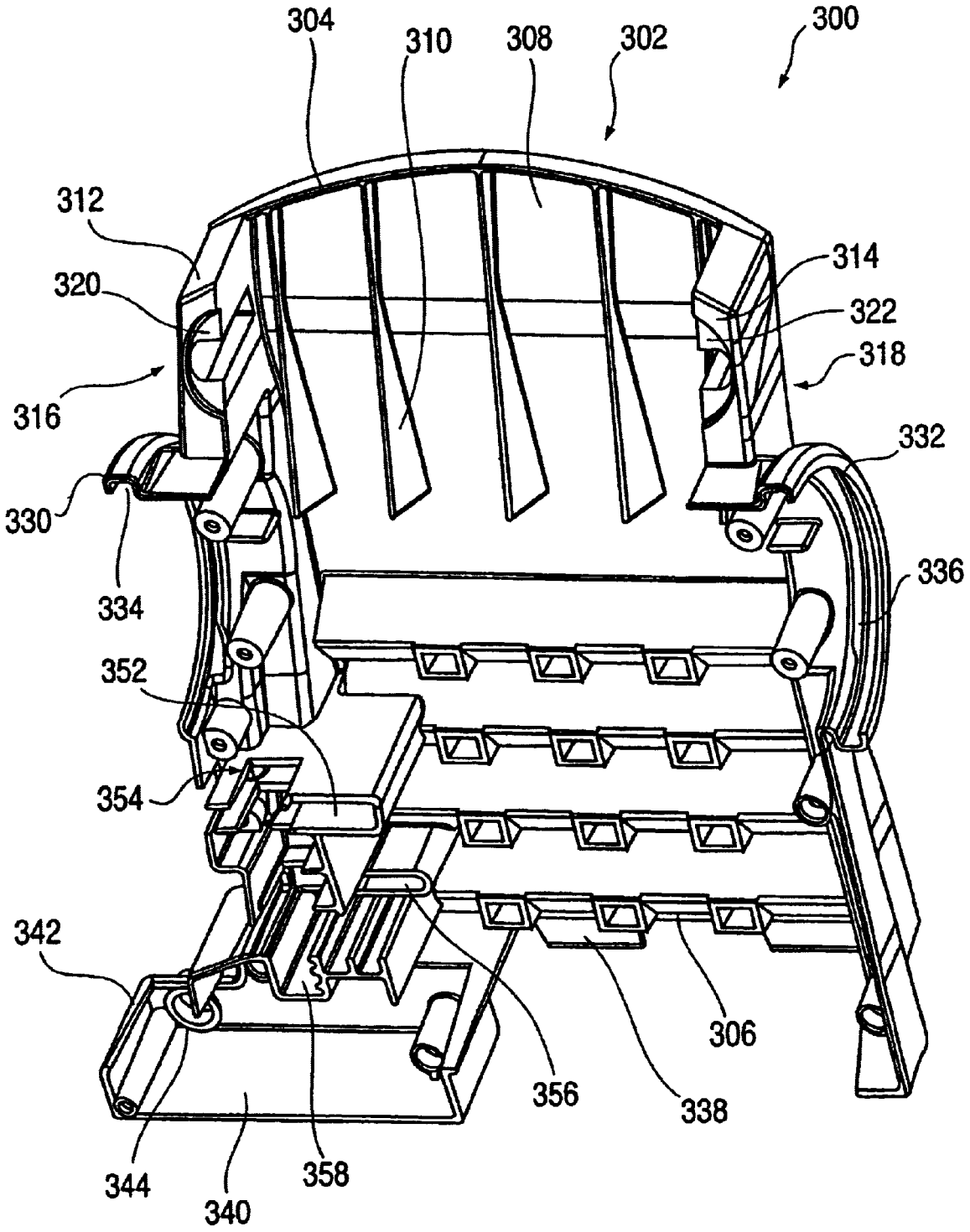
FIG. 12 illustrates a front perspective view of a rear cover of the construction toy device of FIG. 8.

An embodiment of a rear cover is illustrated in FIG. 12. Rear cover 300 includes a guide portion 302 and a mounting portion 340. Rear cover 300 includes an upper end 304 and a lower end 306. In one embodiment, several guide ribs 310 are disposed on inner surface 308 proximate to upper end 304.

As the rear cover 300 is coupled to base 100, tabs 338 along lower end 306 engage slots 164 on the base 100 to retain the rear cover 300 and the base 100 together. Mounting portion 340 includes an extension 342 and an opening 344.. Mounting portion 340 is inserted into opening 148 on the base 100.

In the illustrated embodiment, rear cover 300 includes side walls 312 and 314. Side walls 312 and 314 include mounting portions 316 and 318 with recesses 320 and 322. The mounting portions 316 and 318 are used to couple the upper plate 380 to the housing 92.

In the illustrated embodiment, the rear cover 300 includes collars or shoulders 330 and 332. Similar to collars 256 and 258 on the front cover 200, collars 330 and 332 include grooves 334 and 336 along their inner surfaces.

As illustrated in FIG. 12, rear cover 300 includes a a slot 352, a slot 356, a channel 354, and a cavity 358. These components are discussed in detail below.

Figure 13:
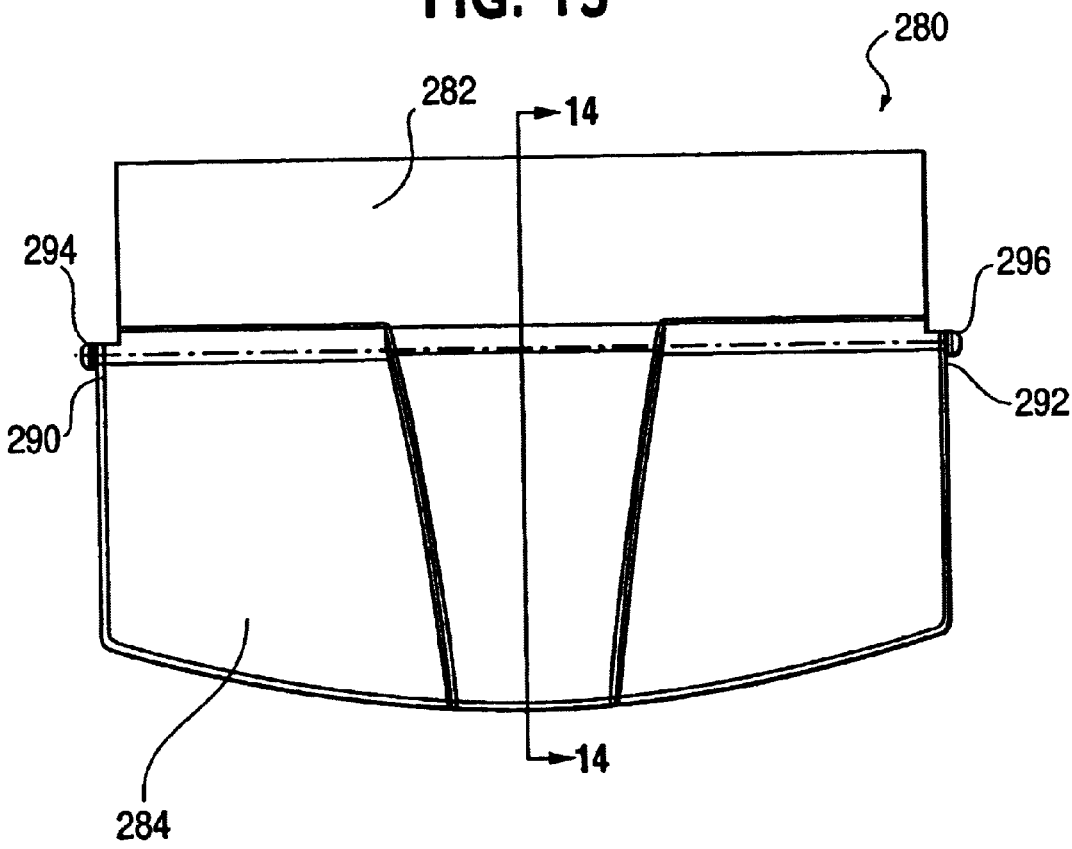
FIG. 13 illustrates a front view of a lower plate of the construction toy device of FIG. 8.
Figure 14:
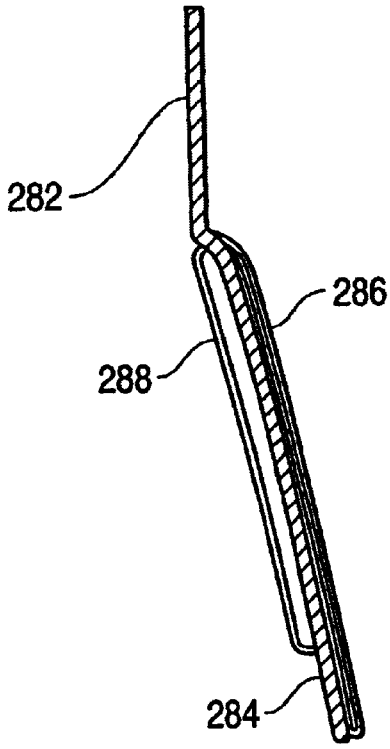
FIG. 14 illustrates a cross-sectional view of the lower plate of FIG. 13 taken along the lines "14—14".

An embodiment of a lower plate is illustrated in FIGS. 13 and 14. Lower plate 280 includes an upper portion 282 and a lower portion 284. In one embodiment, the upper portion 282 is substantially planar and the lower portion 284 is disposed at an angle relative to the upper portion 284. Lower plate 280 includes an outer surface 286 and an inner surface 288.

The lower portion 284 of the lower plate 280 includes sides 290 and 292, each of which includes a post 294 and 296, respectively. Lower plate 280 is positioned adjacent front cover 200 so that the side surfaces 290 and 292 engage notches 214 and 216 and posts 294 and 296 engage openings 218 to couple the lower plate 280 to the front cover 200. When the lower plate 280 is coupled to the front cover 200, inner surface 288 and the guide surface 208 of the front cover 200 define a portion of passageway 92.

Figure 15:
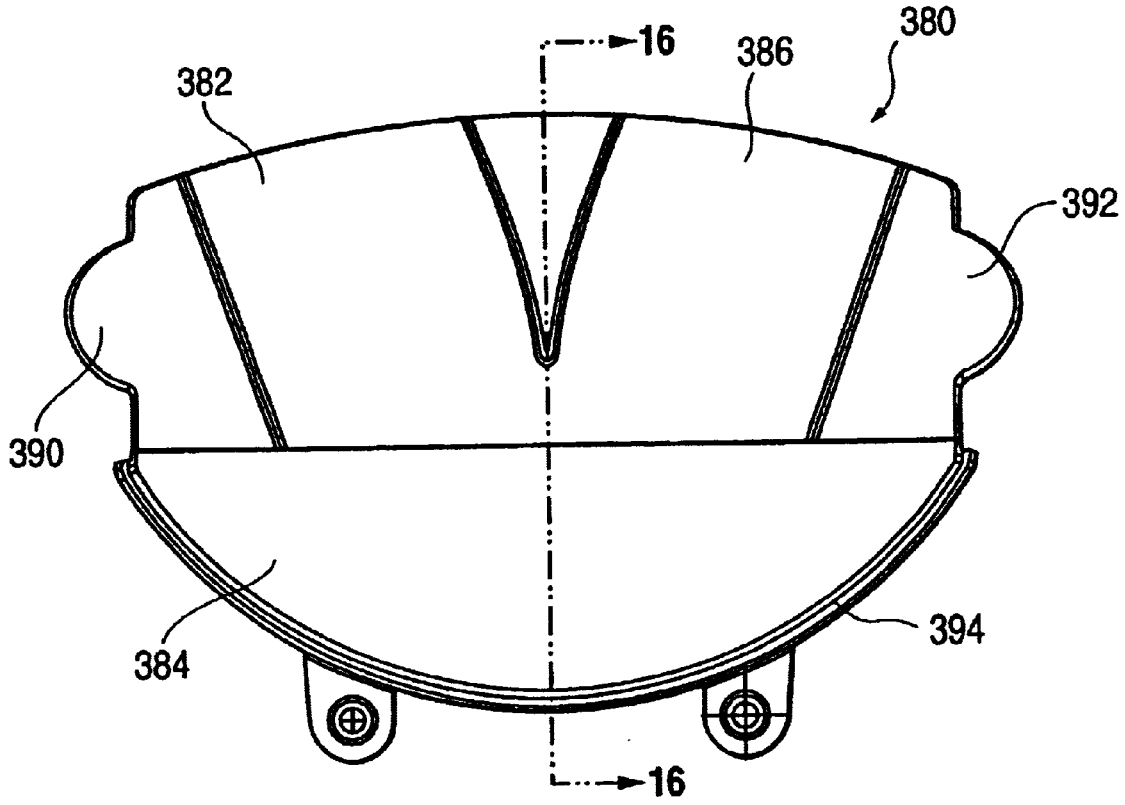
FIG. 15 illustrates a front view of an upper plate of the construction toy device of FIG. 8.
Figure 16:
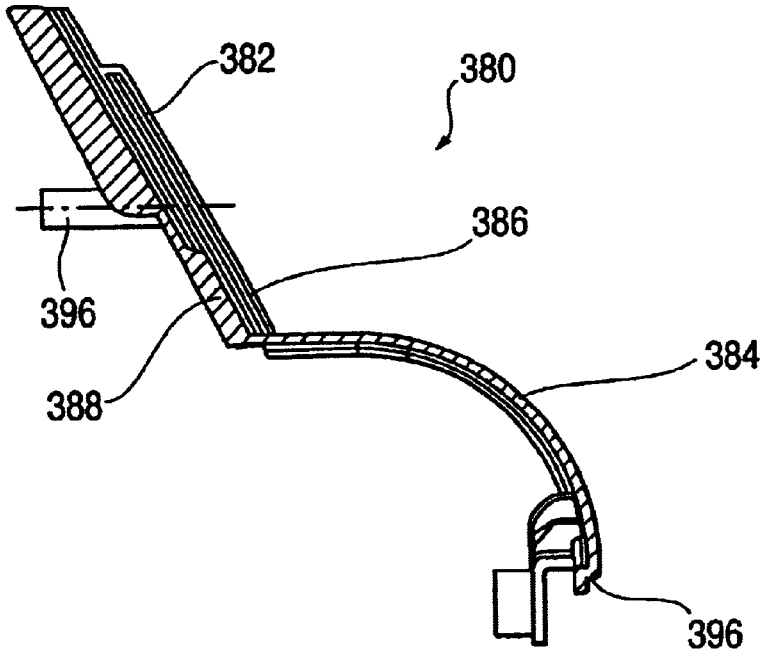
FIG. 16 illustrates a cross-sectional view of the upper plate of FIG. 15 taken along the lines "16—16".

An embodiment of an upper plate is illustrated in FIGS. 15 and 16. Upper plate 380 includes an upper portion 382, lower portion 384, and side portions 390 and 392. Upper plate 380 includes a front surface 386 and a rear surface 388. The lower portion 384 includes a curved lower edge 394 that engages the curved edge 254 of the front cover 200. Each side portion 390 and 392 includes a post 396 disposed on its rear surface. When the upper plate 380 is coupled to the rear cover 300, side portions 390 and 392 engage recesses 320 and 322 on the rear cover 300.

Figure 17:
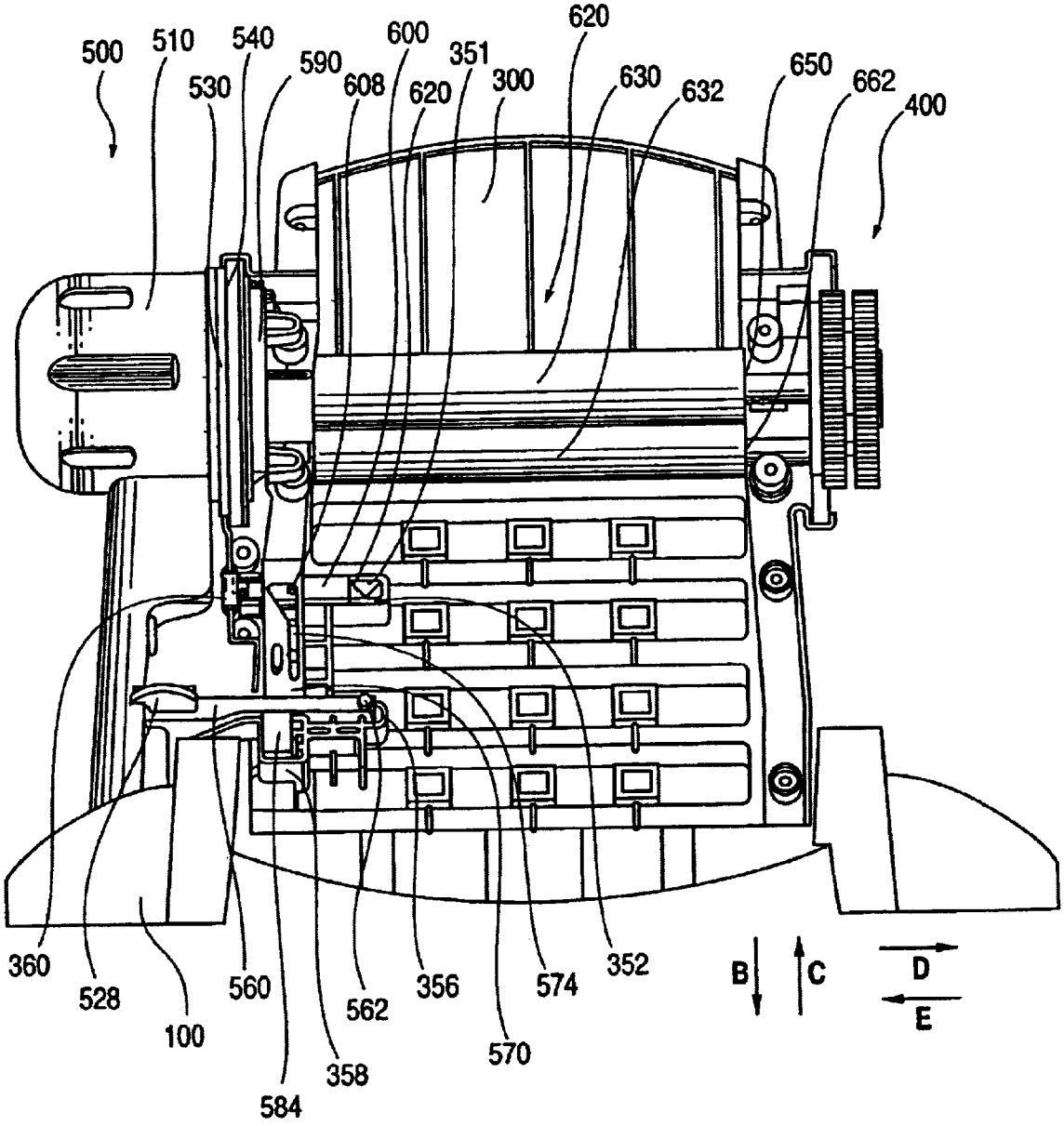
FIG. 17 illustrates an internal front view of several components of the construction toy device of FIG. 8.
Figure 18:
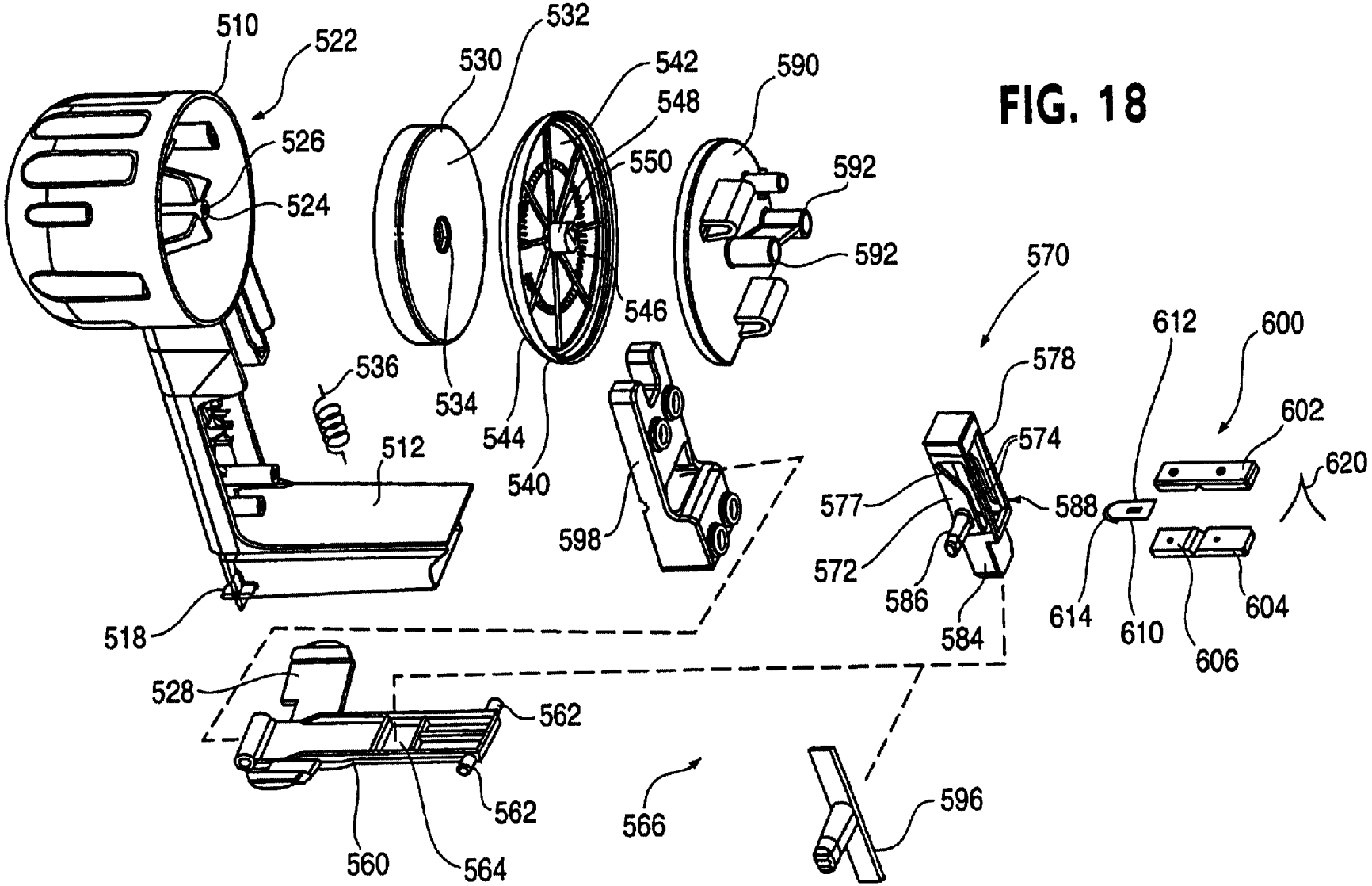
FIG. 18 illustrates an exploded perspective view of a cutter mechanism of the construction toy device of FIG. 8.

Several components of an embodiment of the construction toy device are illustrated in FIGS. 17 and 18. In the illustrated embodiment, the construction toy device 90 includes a die mechanism 620 and a cutter mechanism 500.

The cutter mechanism 500 includes a support arm 510 that is movably coupled to the base 100. Support arm 510 is disposable in a clamping position in which the support arm 510 is proximate to the rear, cover 300 (as illustrated in FIG. 17) and an open position in which the support arm 510 is spaced apart from the rear cover 300.

In the illustrated embodiment in FIG. 18, the support arm 510 includes a clamping portion 522 and a mounting portion 512. The mounting portion 512 includes a pivot 518 disposed on each side. Pivots 518 engage the openings 234 and 344 on the front and rear covers 200 and 300, respectively. The support arm 510 can rotate about pivots 518 between its clamping position and an open position. A biasing mechanism 536 is disposed between the housing 94 and the mounting portion 512 to bias the support arm 510 into its clamping position.

The cutter mechanism 500 includes a plate support 560 as illustrated in FIG. 18. In one embodiment, the plate support 560 is coupled to the support arm 510 via mounting block 598. In an alternative embodiment, plate support can be coupled to the housing.

In the illustrated embodiment, clamping portion 522 includes a shaft 524 having a hole 526. In one embodiment, the cutter mechanism 500 includes an idler plate 530 coupled to the support arm 510. Idler plate 530 includes a support surface 532 and a central aperture 534. The idler plate 530 is rotatably coupled to the clamping arm 510 via a fastener inserted through aperture 534 and into opening 526.

In the illustrated embodiment, the movement of the support arm 510 relative to the housing 92 can be controlled. As the support arm 510 is pulled away from the rear cover 300 along the direction of arrow "E", the support arm 510 rotates about pivots 518.

In the illustrated embodiment, plate support 560 includes an upper surface 528, an opening 564 and bosses 562. A piece of material disposed between idler plate 530 and drive plate 540 can contact and be supported by upper surface 528. Upper surface 528 of plate support 560 can be used to locate the center of the piece of material substantially proximate to the centers of idler plate 530 and drive plate 540.

In one embodiment, one boss 562 engages slot 264 on the front cover 200 and the other boss 562 engages slot 356 on the rear cover 300. As the support arm 510 moves along arrow "E", plate support 560 moves in the same direction and the bosses 562 move along slots 264 and 356. In one embodiment, the range of rotation of support arm 510 is limited by the length of slots 264 and 356. In an alternative embodiment, the range of rotation of the support arm 510 is determined by the support arm structure.

In the illustrated embodiment, the construction toy device 90 includes a locking mechanism that ensures that a user does not have access to the cutting device when the support arm 510 is not in its clamping position. In other words, the locking mechanism does not allow the cutting device to extend from the housing when the support arm 510 is in an open position.

In one embodiment, the locking mechanism 566 includes a link 570 that is slidably mounted in channel 354 between the front and rear covers 200 and 300. Link 570 can engage the plate support 560 and prevent movement of the plate support 560 relative to the front and rear covers 200 and 300. Locking mechanism may be any suitable mechanism that can be manipulated to selectively control the movement of the support arm and/or the cutting device.

In the illustrated embodiment, link 570 includes a front wall 572 and a rear wall 578 that define a passage 588 therebetween. As illustrated in FIG. 18, front and rear walls 572 and 578 include slots 574. Each slot 574 includes a narrow portion 575 and an angled portion 576. The angled portion 576 is defined by a tapered wall 577. Link 570 also includes an extension 584 and a handle 586.

In one embodiment, link 570 can move between an upper position and a lower position. In the lower position (see FIG. 17), extension 584 engages opening 564 in plate support 560. When the extension 584 extends through opening 564, plate support 560 cannot move along the directions of arrows "D" and "E". Since plate support 560 is coupled to the support arm 510, support arm 510 cannot move relative to the housing 92. In order to enable the support arm 510 to rotate, the user moves the link 570 upward and the extension 584 disengages from the opening 564.

In one embodiment, the handle 586 extends through slot 222 on the front cover 200. A user can move the link 570 by sliding handle 586 along slot 222. In an alternative embodiment, a cap 596 may be disposed on handle 586.

In the illustrated embodiment, construction toy device 90 includes a cutter block 600 and a cutter or cutting device 610 coupled to the cutter block 610. As illustrated in FIG. 18, cutter block 600 includes an upper block 602 and a lower block 604. Cutter 610 includes a body portion 612 and a cutting device portion 614. In one embodiment, the lower block 604 includes a cavity 606 that is sized to receive the cutter body portion 612. In an alternative embodiment, each of the lower and upper blocks includes a cavity that is sized to receive a portion of the cutter.

As illustrated in FIG. 17, the cutter block-600 includes a hole 608 through which a rod (not shown) may be inserted. Cutter block 600 is slidably disposed in slot 352. The cutter block 600 can be positioned in an extended or cutting position and a retracted position. A biasing mechanism 620, such as a spring, is positioned between an end of the cutter block 600 and an inner surface of the wall 351 defining slot 352. The biasing mechanism 620 forces the cutter block 600 outward along the direction of arrow "E" to its cutting position. When the cutter block 600 moves along the direction of arrow "E", the cutter 610 extends through a bushing 360 and outside of the housing 92. When the cutter 610 is in its cutting position, it can cut a piece of material being supported by the support arm 510.

As illustrated in FIG. 17, cutter block 600 is disposed in passage 588 in link 570. The rod extending through opening 608 engages slots 574 on the front and rear walls 572 and 578. As the link 570 moves from its lower position along the direction of arrow "C", the tapered walls 577 engage the rod and move the rod along the direction of arrow "D." When the link 570 moves a sufficient distance, the rod is positioned in the narrow portions of slots 574. At this point, cutter block 600 and cutter 610 are in their retracted positions within the housing 92.

In order to extend the cutter 610 from the housing 92, the user moves the link 570 from its upper position along the direction of arrow "B". As the link 570 moves, the rod stays in the narrow portion of each slot 574 until it reaches the angled portions 576. Since the biasing mechanism 620 forces the cutter block 600 along the direction of arrow "E", the rod engages the tapered walls 577 as the sliding plate 570 moves. When the link 570 is in its lower position, cutter block 600 is in its extended position and cutter 610 extends from the housing 92.

In the illustrated embodiment, the die mechanism 620 includes rollers 630 and 632 disposed on axles 650 and 662, respectively. Exemplary embodiments of an axle and a roller are illustrated in FIGS. 20–22.

Figure 20:
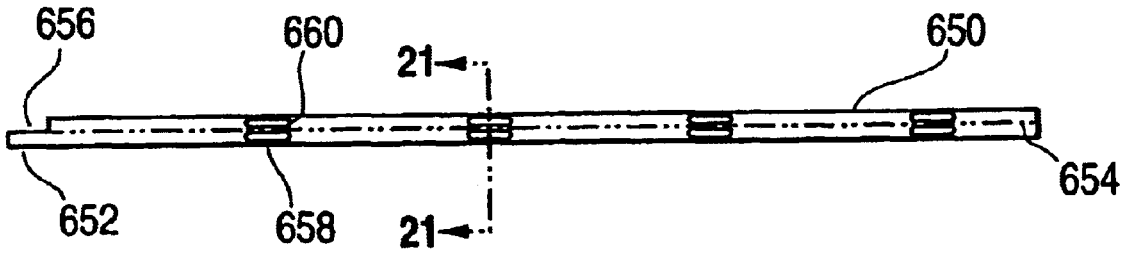
FIG. 20 illustrates a side view of an axle of the construction toy device of FIG. 8.
Figure 21:
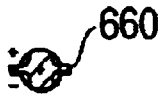
FIG. 21 illustrates a cross-sectional view of the axle of FIG. 20 taken along lines "21—21".

As illustrated in FIG. 20, axle 650 includes a first end 652 and a second end 654. In one embodiment, end 652 includes a narrow portion 656 that has a semi-circular cross-sectional area. Axle 650 includes recesses 658 disposed along its length. Each recess 658 includes a protrusion 660. As illustrated in FIG. 21, axle 650 includes a recess 658 and a protrusion 660 on each side.

Figure 22:
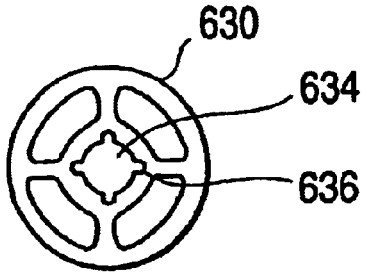
FIG. 22 illustrates an end view of a roller of the construction toy device of FIG. 8.

An embodiment of a roller is illustrated in FIG. 22. Roller 630 includes a central channel 634 extending along the length of the roller 630. Several slots 636 are formed around the circumference of channel 634. As axle 650 is inserted into channel 634, protrusions 660 engage slots 636, thereby operatively coupling the axle 650 and the roller 630.

In the illustrated embodiment, the toy device 90 includes two bearing plates, each of which is supported by a collar on the front cover 200 and a corresponding collar on the rear cover 300. One of the bearing plates, plate 590, is illustrated in FIGS. 17 and 18. Bearing plate 590 includes mounts 592 into which the ends of the axles 650 and 662 are inserted.

The construction toy device 90 includes a drive plate 540 as illustrated in FIG. 18. Drive plate 540 includes an inner surface 542 and an outer surface 544. The drive plate 540 includes a column 548 coupled to the inner surface 542. The column 548 includes an aperture 550. In one embodiment, aperture 550 has a semi-circular cross-section. In alternative embodiments, the aperture may have other cross-sectional configurations.

In the illustrated embodiment, the outer surface 544 of the drive plate 540 includes a mechanism that increases the coefficient of the friction of the outer surface 544. An increase in the coefficient of friction enhances the gripping and rotating of a piece of material disposed between idler plate 530 and drive plate 540. For example, the outer surface 544 can include a raised pattern, nubs, an adhesive, etc. Alternatively, a textured piece of material, such as sandpaper, can be coupled to the outer surface 544.

In the illustrated embodiment, axle 650 extends through column 592 of bearing plate 590 and the narrow portion 656 of the axle 650 engages aperture 550 of drive plate 540. As axle 650 rotates, the drive plate 540 rotates. When the support arm 510 is in its clamping position, idler plate 530 is disposed proximate to drive plate 540. Thus, when a piece of material is placed between idler plate 530 and drive plate 540, rotation of the drive plate 540 causes the piece of material and the idler plate 530 to rotate.

In the illustrated embodiment, the construction toy device 90 includes an actuator or operating mechanism. The actuator can be used to reduce the speed of the drive roller of the die mechanism, thereby increasing the applied torque. While the actuator in the illustrated embodiment is manually operated, the actuator may be electronically driven, such as by a motor. Moreover, while the actuator is illustrated as operatively coupled to the die mechanism and the cutter mechanism, the actuator may include different portions coupled to the die mechanism and the cutter mechanism, each of which can be independently operated.

Figure 19:
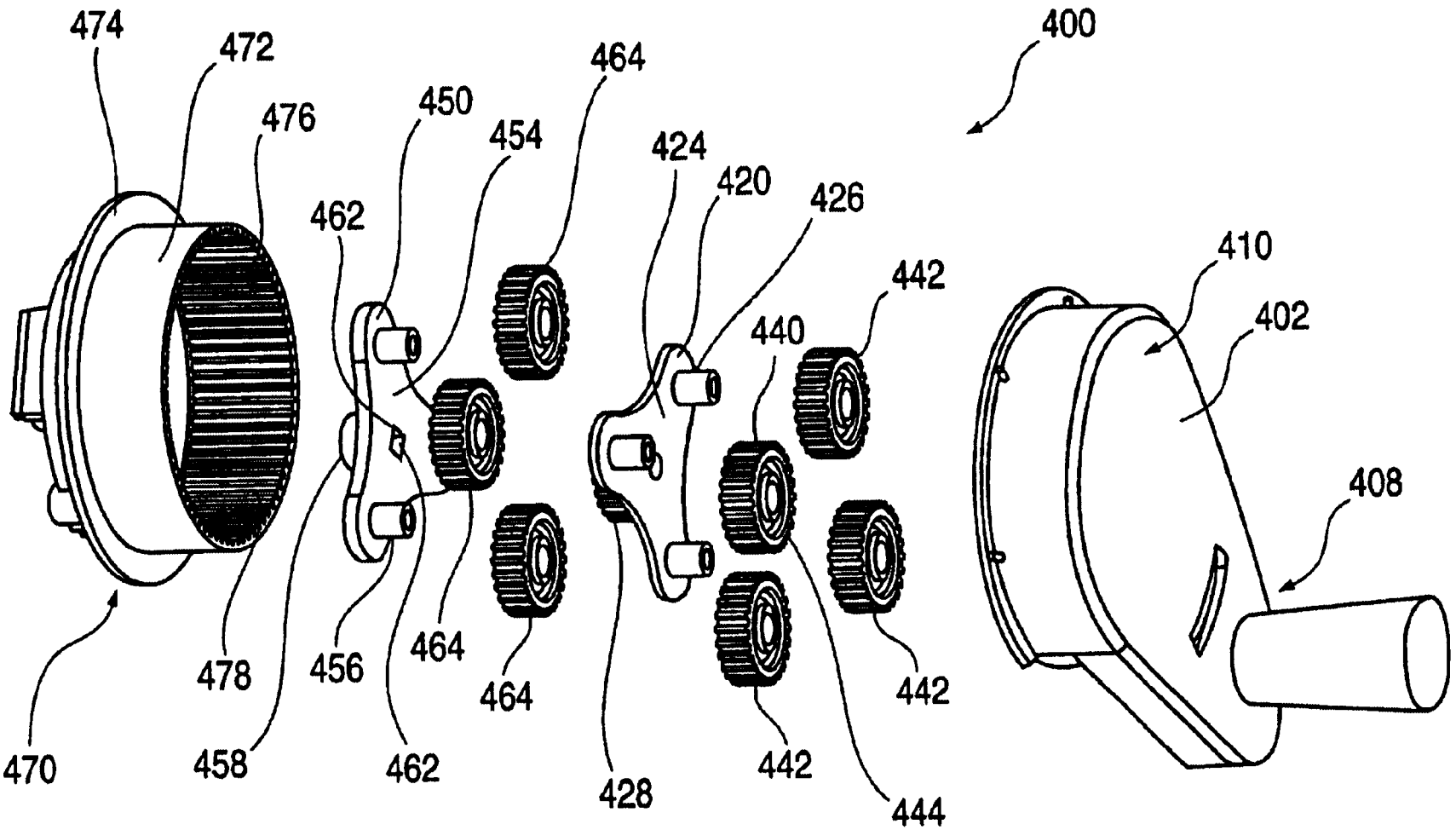
FIG. 19 illustrates an exploded perspective view of an actuator of the construction toy device of FIG. 8.

An embodiment of an actuator is illustrated in FIG. 19. Actuator 400 includes a crank arm 402, a series of gears and follower plates, and a bearing plate 470. In one embodiment, the crank arm 402 includes a handle portion 408 and a drive portion 410. The drive portion 410 includes an inner surface having an extension (not shown) formed on thereon. In one embodiment, the extension is hexagonal shaped.

In the illustrated embodiment, the actuator 400 includes a gear 440 with an engagement portion 444 disposed around the center of the gear 400. The configuration of the engagement portion 444 corresponds to the configuration of the extension on the crank arm 402. In one embodiment, the engagement portion 444 is hexagonal shaped. In alternative embodiments, the extension and the engagement portion 444 may be any particular configurations or shapes that enable the crank arm 402 to operatively engage the gear 400.

The actuator 400 includes a plate 420 with an outer surface 422 and an inner surface 424. In the illustrated embodiment, the plate 420 includes posts 426 on which gears 442 are rotatably mounted. Plate 420 includes a gear 428 fixed to the inner surface 424.

The actuator 400 also includes a plate 450 with an outer surface 454 and an inner surface 452. The plate 450 includes posts 456 on which gears 464 are rotatably mounted. A column 458 with an aperture 460 extending therethrough is disposed on the inner surface 452 of plate 450. As illustrated in FIG. 19, the aperture 460 includes slots 462 located around the perimeter of the aperture 460.

As illustrated in FIG. 19, the actuator 400 includes a bearing plate 470. In one embodiment, bearing plate 470 includes a sleeve 472 and a flange 474 coupled to the sleeve 472. The inner surface 476 of the sleeve 472 includes teeth 478. Bearing plate 470 is supported in collars 258 and 332 of the front and rear covers 200 and 300.

Now the operation of the actuator is described. As a user rotates the crank arm 402, gear 440 rotates. Since gear 440 engages gears 442, the rotation of gear 440 rotates gears 442. Gears 442 are also in engagement with the teeth 478 of bearing wheel 470. As a result, the rotation of gears 442 causes plate 420 and gear 428 to rotate. Gear 428 engages gears 464 and as a result, plate 450 rotates. In the illustrated embodiment, axle 650 is operatively coupled to plate 450. Hence, the rotation of plate 450 causes the rotation of axle 650 and roller 630.

In the illustrated embodiment, construction toy device 90 includes several punches or punching mechanisms. The punches can be used to create additional patterns in a piece of material that has been passed through the die mechanism.

Figure 23:
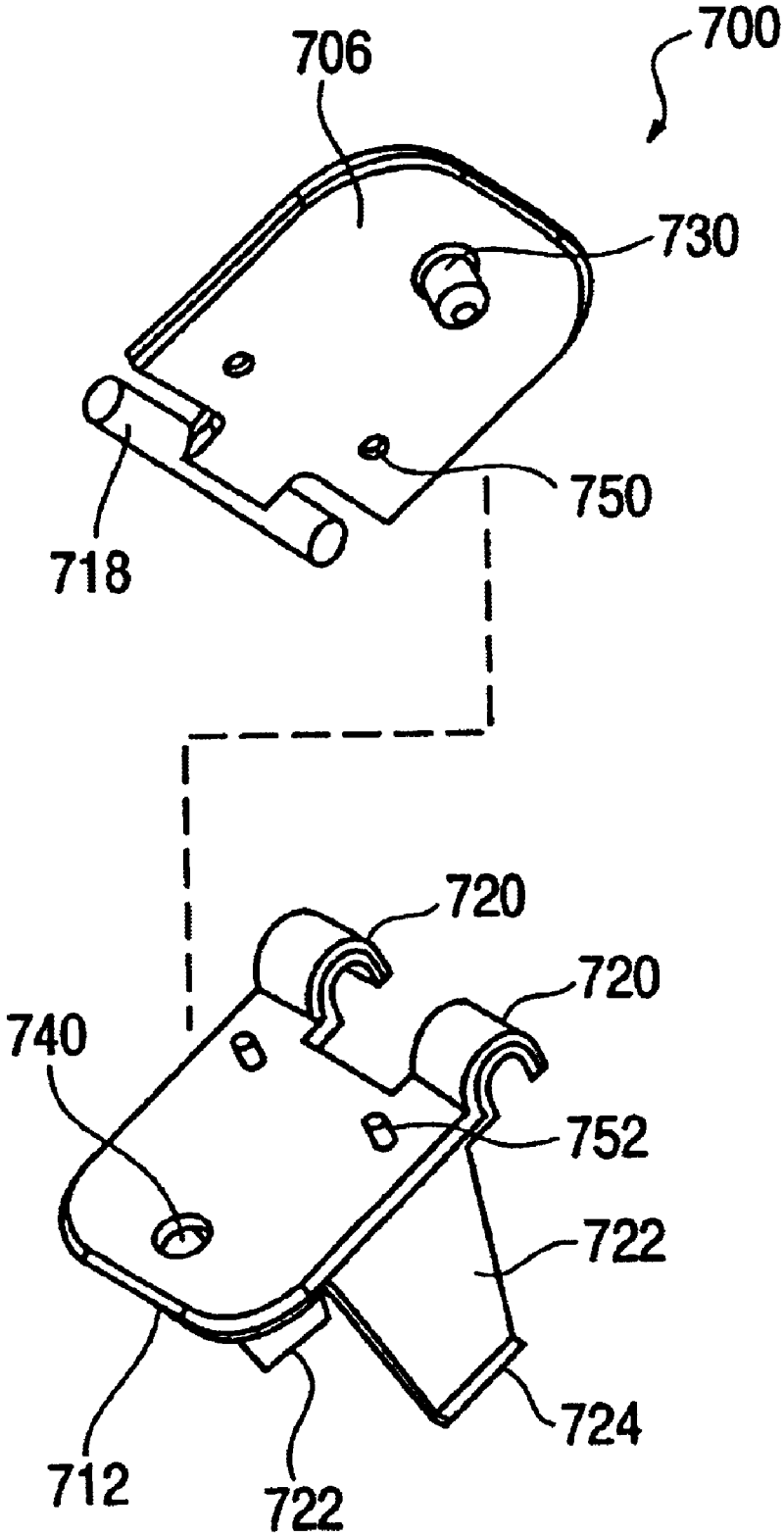
FIG. 23 illustrates an exploded perspective view of a punch embodying the principles of the invention.

An embodiment of a punch is illustrated in FIG. 23. In one embodiment, punch 700 includes an upper portion 706 and a lower portion 712. Upper portion 706 includes an axle 718 coupled one end and a protrusion 730 disposed on its bottom surface. Upper portion 706 also includes alignment holes 750.

Lower portion 712 includes a pair of U-shaped channels 720 disposed at one end and an opening 740. Lower portion 712 also includes a pair of extensions 752 disposed on its upper surface. Lower portion 712 includes a pair of legs 722 with tabs 724. Each leg 722 is disposed on an opposite side of the lower portion 712.

Axle 718 is placed beneath the U-shaped channels 720 and the upper portion 706 is disposed above the lower portion 712. When the upper portion 706 is pivoted into contact with the lower portion 712, extensions 752 engage the alignment holes 750 to align the upper and lower portions. The legs 722 are inserted into the slots 130 and 132 in the base 100.

A user can place a piece of material between the upper and lower portions 706 and 712 and press down on the upper portion 706 so that protrusion 730 punches through the material and opening 740. As illustrated in FIG. 23, protrusion 730 has a circular cross-section. In alternative embodiments, the protrusion can have an elongate blade-like cross-section or any other cross-section and may include multiple elements (e.g., two elongate blade-like protrusions). Alternative punches 702 and 704 are illustrated in FIG. 8.

Now the operation of the construction toy device is described. A user moves the support arm 510 away from the housing and places a piece of material between the idler plate 530 and the drive plate 540. The user releases the support arm 510, which returns to its clamping position. The piece of material is supported between the idler plate 530 and the drive plate 540 and engages the cutter 610.

As the user rotates the crank arm 402, the piece of material rotates and the cutter 610 cuts the piece of material into two separate pieces 72 and 74. The user places the work piece 72 into the die shell 80. The die shell 80 is inserted into the passageway 94. The user rotates the crank arm 402 to advance the die shell 80 between rollers 630 and 632. The die shell 80 exits the passageway 94 through outlet portion 98. The user can open the die shell 80 and remove the construction elements that have been formed from the work piece 72.

In an alternative embodiment, the work piece that is placed into the die shell can be a raw piece of material. In other words, the work piece does not have to be processed or shaped by the cutter mechanism before it passes through the die mechanism.

Figure 24:
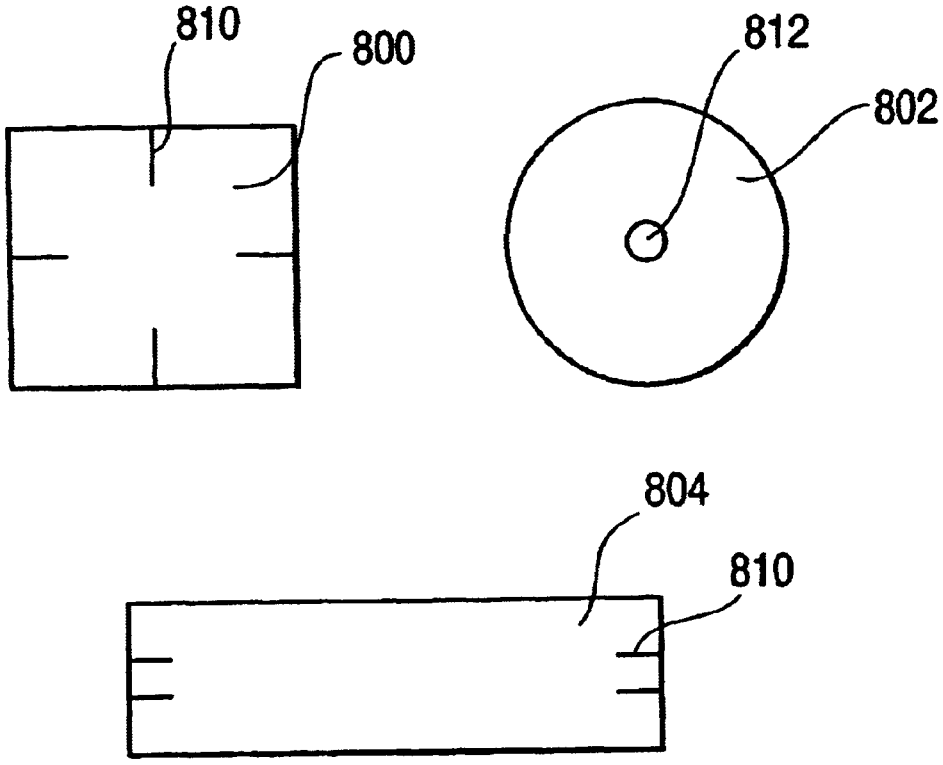
FIG. 24 illustrates several embodiments of construction elements embodying the principles of the invention.

Several embodiments of construction elements are illustrated in FIG. 24. Construction elements 800, 802, and 804 can be formed from one or more pieces of material. Construction elements 800 and 804 include slits 810 that enable the construction elements to be coupled together. Similarly, construction element includes a opening 812 through which an elongate member, such as a straw, can be inserted.

In one embodiment, the configurations of the construction elements are determined by the patterns on the die shells. For example, construction elements can be formed to create objects or articles such as vehicles, animals, characters, structures, flowers, airplanes, etc.

Figure 25:
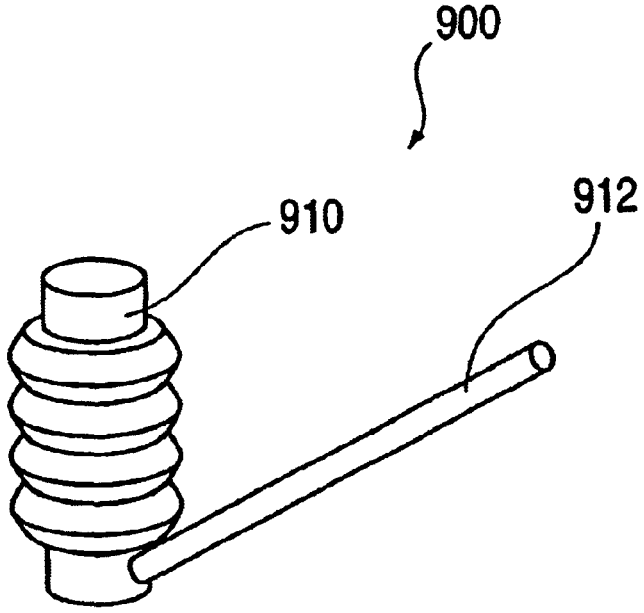
FIG. 25 illustrates an activation device embodying the principles of the invention.

An embodiment of an activation device is illustrated in FIG. 25. Activation device 900 is a mechanism that can be used to impart movement to a structure formed from multiple construction elements. In the illustrated embodiment, activation device 900 includes a bellows 910 and a mounting portion 912 operatively coupled to the bellows. In one embodiment, mounting portion 912 is a tube through which air from the bellows can flow. A user can place a structure, such as an airplane, on the mounting portion 912 and press down on the bellows to impart motion to the structure.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. An apparatus for creating a construction element from a piece of material, comprising:

a housing;

an axle coupled to said housing;

a die mechanism coupled to said housing and having a roller mounted on said axle and adapted to advance a die shell;

a cutter mechanism coupled to said housing, said cutter mechanism including a support portion and a cutting device, said support portion including a first mounting plate rotatably supported on said axle on an exterior surface of said housing, said cutter mechanism also having a support arm having a first end and a second end, said first end being pivotally supported on said housing, said support arm having a second mounting plate rotatably disposed on said second end, said support arm and said second mounting plate disposable in a clamping position proximate to said first mounting plate and an open position spaced apart from said first mounting plate, whereby a workpiece placed between said first and second mounting plates may be rotated past said cutting device to create circular cut products.

2. The apparatus of claim 1, further comprising:

an end of said axle being coupled to a driven gear, and said first mounting plate being coupled to said driven gear, the rotation of said axle causing said first mounting plate and said roller to rotate.

3. The apparatus of claim 1, wherein said housing includes a first side wall, a second side wall, and a guide surface extending therebetween, and a plate releasably coupled to said first and second side walls, and said guide surface, said plate, and said first and second side walls defining a passageway therebetween.

4. The apparatus of claim 1, wherein said housing includes a first side wall, a second side wall, and a guide surface extending therebetween, said first and second side walls and said guide surface defining a passageway therebetween.

5. The apparatus of claim 1, further comprising:

an actuator coupled to said housing, said actuator operably coupled to said cutter mechanism and adapted to rotate said first mounting plate, said actuator being operably coupled to and adapted to rotate said roller.

6. The apparatus of claim 1, further comprising:

an actuator coupled to said housing, said actuator operably coupled to and adapted to rotate said roller, said actuator including a drive arm and a drive plate, said axle being coupled to said drive plate such that rotation of said drive arm causes said drive plate to rotate, thereby rotating said axle and said roller.

7. The apparatus of claim 1, further comprising:

a die shell, said die shell including a first die portion and a second die portion, said first die portion being coupled to and moveable relative to said second die portion, at least one of said first and second die portions including a surface with a raised pattern formed thereon, said pattern corresponding to the configuration of the construction element.

8. The apparatus of claim 1, wherein the piece of material is adapted to be cut into several pieces which have sufficient structural rigidity to be assembled to form an object.

9. The apparatus of claim 1, wherein said housing includes a base having a punch coupled thereto, said punch adapted to remove a portion of the piece of material.

10. The apparatus of claim 1, further comprising:

a locking mechanism coupled to said housing, said locking mechanism adapted to retain said cutting device in said housing when said support arm is in an open position.

11. The apparatus of claim 10, wherein said cutting device is selectively disposable in a retracted position and in an extended position, said locking mechanism adapted to allow said cutting device to move to said extended position when said support arm is in said clamping position.

12. An apparatus for creating a construction element from a piece of material, comprising:

a housing;

an axle rotatable coupled to said housing;

a die mechanism coupled to said housing, said die mechanism including a roller mounted on said axle and adapted to advance a die shell;

a cutter mechanism coupled to said housing and including a support portion coupled to said axle for rotation therewith about an axis of rotation, said support portion adapted to retainably support the piece of material, and a cutter radially spaced from said axis of rotation, wherein the piece of material supported on said support portion may be rotated past said cutter to create a circular cut product; and an actuator coupled to said housing and operably coupled to said axle, wherein movement of said actuator causes rotation of said axle, rotation of said axle causing rotation of the piece of material if the piece of material is supported by said support portion and causing said die mechanism to advance the die shell if received therein.

13. The apparatus of claim 12, wherein said support portion including a first mounting plate rotatably supported on said axle, said cutter mechanism further includes a support arm having a first end and a second end, said first end being pivotally supported on said housing, said support arm having a second mounting plate rotatably disposed on said second end, said support arm and said second mounting plate disposable in a clamping position proximate to said first mounting plate and an open position spaced apart from said first mounting plate.

14. The apparatus of claim 12, wherein said housing includes a first side wall, a second side wall, and a guide surface extending therebetween, said first and second side walls and said guide surface defining a passageway therebetween.

15. The apparatus of claim 12, further comprising:

a die shell, said die shell including a first die portion and a second die portion, said first die portion being coupled to and moveable relative to said second die portion, at least one of said first and second die portions including a surface with a raised pattern formed thereon, said pattern corresponding to the configuration of the construction element.

16. The apparatus of claim 12, wherein said axle has a first end and a second end, said actuator engages said first end, said housing includes a driven gear coupled thereto, said driven gear being coupled to said second end and said cutter mechanism, and rotation of said axle causes said driven gear and a portion of said cutter mechanism to rotate.

17. The apparatus of claim 12, wherein the piece of material is adapted to be cut into several pieces which have sufficient structural rigidity to be assembled to form an object.

18. The apparatus of claim 12, wherein said housing includes a base having a punch coupled thereto, said punch adapted to remove a portion of the piece of material.

19. The apparatus of claim 12, further comprising:

a locking mechanism coupled to said housing, said locking mechanism adapted to retain said cutting device in said housing when said support arm is in an open position.

20. The apparatus of claim 19, wherein said cutting device is selectively disposable in a retracted position and in an extended position, said locking mechanism adapted to allow said cutting device to move to said extended position when said support arm is in said clamping position.

* * * * *